US009328405B2

(12) United States Patent
Siller et al.

(10) Patent No.: US 9,328,405 B2
(45) Date of Patent: May 3, 2016

(54) STEEL ALLOY FOR MACHINE COMPONENTS

(75) Inventors: Ingo Siller, Semriach (AT); Herbert Schweiger, Wartberg (AT); Devrim Caliskanoglu, Bruck/Mur (AT); Silvia Zinner, St. Lorenzen (AT)

(73) Assignee: BOEHLER EDELSTAHL GMBH & CO KG, Kapfenbert (AT)

( * ) Notice: Subject to any disclaimer, the term of this patent is extended or adjusted under 35 U.S.C. 154(b) by 944 days.

(21) Appl. No.: 12/625,084

(22) Filed: Nov. 24, 2009

(65) Prior Publication Data

US 2010/0147423 A1 Jun. 17, 2010

(30) Foreign Application Priority Data

Dec. 5, 2008 (AT) ..... A 1904/2008

(51) Int. Cl.

| | |
|---|---|
| ***C21D 8/00*** | (2006.01) |
| ***C22C 38/00*** | (2006.01) |
| ***C22C 38/22*** | (2006.01) |
| ***C22C 38/24*** | (2006.01) |

(52) U.S. Cl.
CPC ..... *C22C 38/22* (2013.01); *C22C 38/24* (2013.01)

(58) Field of Classification Search
CPC ..... C21D 8/00; C21D 38/00; C21D 38/22
USPC ..... 148/328, 334, 335, 332, 579
See application file for complete search history.

(56) References Cited

U.S. PATENT DOCUMENTS

| | | | | |
|---|---|---|---|---|
| 2,893,902 | A * | 7/1959 | Roberts et al. | 148/621 |
| 5,651,842 | A * | 7/1997 | Nakamura et al. | 148/321 |
| 6,773,662 | B2 | 8/2004 | Fisher et al. | |
| 2003/0098097 | A1 | 5/2003 | Fisher et al. | |

FOREIGN PATENT DOCUMENTS

| | | | |
|---|---|---|---|
| EP | 1 300 482 | A1 | 4/2003 |
| GB | 981288 | A * | 1/1965 |
| JP | 10121201 | A * | 5/1998 |
| JP | 2002-121648 | A | 4/2002 |
| JP | 10-121201 | A | 4/2003 |
| JP | 2004-169177 | A | 6/2004 |
| JP | 2004169177 | A * | 6/2004 |

OTHER PUBLICATIONS

English language abstract of JP 10-121201 A, Apr. 9, 2003.
English language abstract of JP 2004-169177 A, May 12, 1998.
English language abstract of JP 2002-121648 A, Apr. 26, 2002.

* cited by examiner

*Primary Examiner* — Sikyin Ip
(74) *Attorney, Agent, or Firm* — Greenblum & Bernstein, P.L.C.

(57) ABSTRACT

A machine component or part for alternating mechanical stresses up to a temperature of at most 160° C. The component or part comprises a thermally quenched and tempered steel alloy which contains carbon, silicon, manganese, chromium, molybdenum and vanadium in certain concentrations, the remainder being iron (Fe) and accompanying elements and contaminants due to smelting. This abstract is neither intended to define the invention disclosed in this specification nor intended to limit the scope of the invention in any way.

12 Claims, 3 Drawing Sheets

STEEL ALLOY FOR MACHINE COMPONENTS

CROSS-REFERENCE TO RELATED APPLICATIONS

The present application claims priority under 35 U.S.C. §119 of Austrian Patent Application No. A 1904/2008, filed on Dec. 5, 2008, the disclosure of which is expressly incorporated by reference herein in its entirety.

BACKGROUND OF THE INVENTION

1. Field of the Invention

The present invention relates to machine components or parts with a tensile strength of greater than 2000 MPa for alternating mechanical stresses up to a temperature of about 160° C., formed from a thermally quenched and tempered steel alloy. In particular, the invention relates to the engine components and/or drive train components of vehicles.

2. Discussion of Background Information

In modern technology machine components subjected to alternating mechanical load stress are increasingly more highly loaded, up to the limits of the respective material resistance. This applies in particular to components of vehicles, because the weight reductions achieved thereby are also useful for savings in terms of fuel and the like.

High values for the toughness, strength and ductility property profile in the thermally quenched and tempered state are demanded of the materials from which the components are made, because these properties are of crucial importance for a dimensional design of the parts.

As became evident, due to the failure of parts in sustained operation material fatigue also needs to be taken into account in order to achieve a high operational reliability.

For parts subjected to major mechanical alternating stress in the field of railways, automobiles and aircraft, alloyed, optionally low-alloy quenched and tempered steels are generally used at present. A preferred representative of these steels is the alloy according to DIN material no. 1.6928. This rather low-alloy material contains 1.40 to 1.90% by weight of silicon in order to largely ensure high endurance strength. An attempt has also been made to increase the silicon content of this alloy up to 3.0% by weight in order to achieve the best fatigue properties of the material when the parts are under stress.

The use of steel alloys with a composition according to that of quenched and tempered steels of the aforementioned type has proven to be useful for a production of highly stressed machine components according to the prior art, but the fatigue properties thereof are often not sufficient for a mechanical alternating stress of a material which is used in the limit value range.

It would be advantageous to be able to provide machine components or parts with a tensile strength of greater than about 2,000 MPa which are to be subjected to alternating mechanical stresses in the thermally quenched and tempered state up to a temperature of about 160° C. and have much improved long-term properties and a high modulus of elasticity.

SUMMARY OF THE INVENTION

The present invention provides a machine component or part for alternating mechanical stresses up to a temperature of up to about 160° C. The component or part comprises a thermally quenched and tempered steel alloy which comprises in % by weight, based on the total weight of the alloy:

| | |
|---|---|
| Carbon (C) | from about 0.48 to about 0.55 |
| Silicon (Si) | from about 0.18 to about 0.25 |
| Manganese (Mn) | from about 0.35 to about 0.45 |
| Chromium (Cr) | from about 4.40 to about 4.70 |
| Molybdenum (Mo) | from about 2.90 to about 3.10 |
| Vanadium (V) | from about 0.72 to about 0.77, |

the remainder being iron (Fe) and accompanying elements and contaminants due to smelting.

In one aspect, the component or part may have a tensile strength of greater than about 2,000 MPa.

In another aspect, maximum concentrations of one or more of the accompanying elements and contaminants in % by weight, based on the total weight of the alloy, may be:

| | |
|---|---|
| Phosphorus (P) | not more than about 0.005 |
| Sulfur (S) | not more than about 0.001 |
| Nickel (N) | not more than about 0.1 |
| Copper (Cu) | not more than about 0.1 |
| Cobalt (Co) | not more than about 0.1 |
| Titanium (Ti) | not more than about 0.005 |
| Aluminum (Al) | not more than about 0.01 |
| Nitrogen (N) | not more than about 0.003 |
| Oxygen (O) | not more than about 0.002 |
| Calcium (Ca) | not more than about 0.001 |
| Magnesium (Mg) | not more than about 0.001 |
| Tin (Sn) | not more than about 0.005. |

For example, the alloy may comprise, in % by weight, based on the total weight of the alloy:

| | |
|---|---|
| Phosphorus (P) | from about 0 to not more than about 0.005 |
| Sulfur (S) | from about 0 to not more than about 0.001 |
| Nickel (N) | from about 0 to not more than about 0.1 |
| Copper (Cu) | from about 0 to not more than about 0.1 |
| Cobalt (Co) | from about 0 to not more than about 0.1 |
| Titanium (Ti) | from about 0 to not more than about 0.005 |
| Aluminum (Al) | from about 0 to not more than about 0.01 |
| Nitrogen (N) | from about 0 to not more than about 0.003 |
| Oxygen (O) | from about 0 to not more than about 0.002 |
| Calcium (Ca) | from about 0 to not more than about 0.001 |
| Magnesium (Mg) | from about 0 to not more than about 0.001 |
| Tin (Sn) | from about 0 to not more than about 0.005. |

In another aspect, the component or part may have a hardness adjusted through thermal quenching and tempering of greater than about 54 HRC, e.g., greater than about 55 HRC and/or the component or part may have a modulus of elasticity of the material of greater than about 200,000 MPa, e.g., greater than about 205,000 MPa.

The present invention also provides a vehicle (e.g., an automobile, train or aircraft) which comprises the machine part or component of the invention set forth above (including the various aspects thereof). For example, the engine, the drive train and/or a spring of the vehicle may comprise the component or part of the present invention.

The present invention also provides a method of manufacturing a machine component or part having a tensile strength of greater than about 2,000 MPa for alternating mechanical stresses up to a temperature of up to about 160° C. The method comprises manufacturing the component or part by using a thermally quenched and tempered steel alloy which comprises in % by weight, based on the total weight of the alloy:

| | |
|---|---|
| Carbon (C) | from about 0.48 to about 0.55 |
| Silicon (Si) | from about 0.18 to about 0.25 |
| Manganese (Mn) | from about 0.35 to about 0.45 |
| Chromium (Cr) | from about 4.40 to about 4.70 |
| Molybdenum (Mo) | from about 2.90 to about 3.10 |
| Vanadium (V) | from about 0.72 to about 0.77, |

the remainder being iron (Fe) and accompanying elements and contaminants due to smelting.

BRIEF DESCRIPTION OF THE DRAWINGS

The present invention is further described in the detailed description which follows, in reference to the plurality of drawings by way of non-limiting examples of exemplary embodiments of the present invention, and wherein.

DETAILED DESCRIPTION OF THE PRESENT INVENTION

Figure 1:
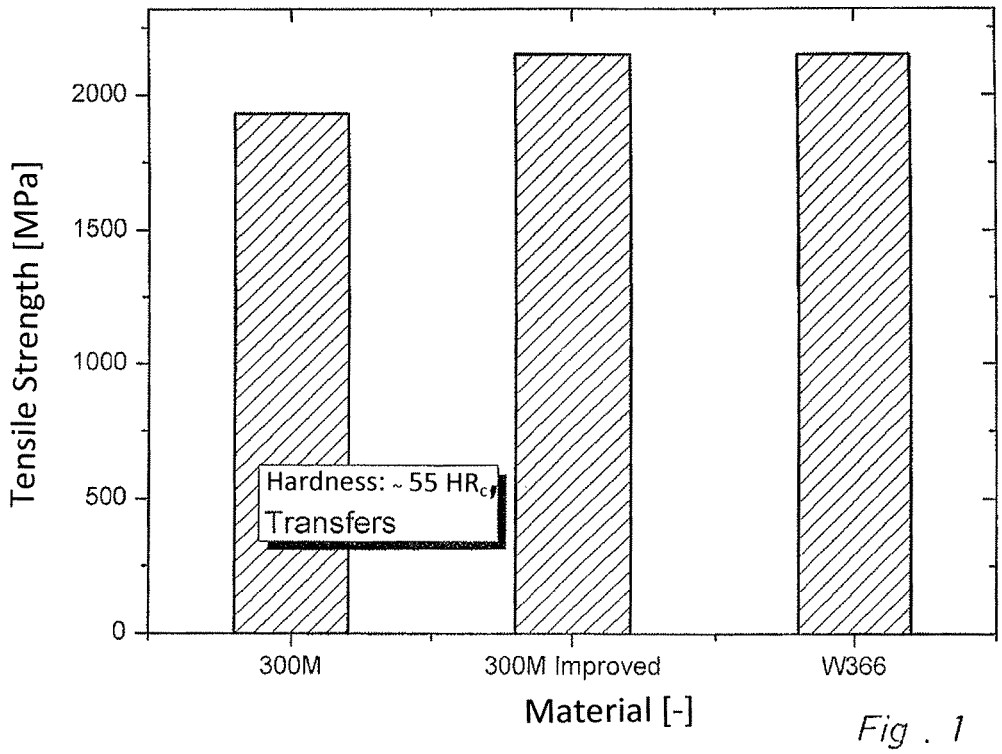
FIG. 1 is a bar chart representing the tensile strengths of a part according to the present invention and comparative parts made from alloys of the prior art.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As set forth above, the present invention provides a thermally quenched and tempered steel alloy for machine components and/or parts of the type mentioned at the outset, which has the following chemical composition in % by weight, based on the total weight of the alloy:

| | |
|---|---|
| Carbon (C) | from about 0.48 to about 0.55 |
| Silicon (Si) | from about 0.18 to about 0.25 |
| Manganese (Mn) | from about 0.35 to about 0.45 |
| Chromium (Cr) | from about 4.40 to about 4.70 |
| Molybdenum (Mo) | from about 2.90 to about 3.10 |
| Vanadium (V) | from about 0.72 to about 0.77 |

the remainder being iron (Fe) and accompanying elements and contaminants due to smelting.

Advantages associated with the use of a material according to the invention may essentially be seen in that machine components of the cited type have a much higher fatigue safety at high stresses with the same or improved mechanical strength properties. Furthermore, the material or the component according to the invention has a much higher modulus of elasticity, which leads to lower expansion values in the elastic range with the same specific mechanical stress and thus to a higher service life of the parts.

Accompanying elements and contaminant elements may be the cause of impaired long-term properties, because these elements are enriched at the grain boundaries of the microstructure or can form compounds. It was found that with long-term alternating stress the material properties are impaired only slightly if the highest contents of one of more of the following accompanying elements or contaminant elements is in % by weight:

| | |
|---|---|
| Phosphorus (P) | not higher than about 0.005 |
| Sulfur (S) | not higher than about 0.001 |
| Nickel (N) | not higher than about 0.1 |
| Copper (Cu) | not higher than about 0.1 |
| Cobalt (Co) | not higher than about 0.1 |
| Titanium (Ti) | not higher than about 0.005 |
| Aluminum (Al) | not higher than about 0.01 |
| Nitrogen (N) | not higher than about 0.003 |
| Oxygen (O) | not higher than about 0.002 |
| Calcium (Ca) | not higher than about 0.001 |
| Magnesium (Mg) | not higher than about 0.001 |
| Tin (Sn) | not higher than about 0.005. |

With an aforementioned chemical composition a homogeneous distribution and a hardness of greater than about 54 HRC, in particular greater than about 55 HRC, formed free from peak values can advantageously be adjusted by means of thermal quenching and tempering, which increases the fatigue safety.

The level of purity of the steel alloy is of particular importance with respect to a crack initiation. It was found that in a material which is thermally quenched and tempered to high strength values even small non-metallic inclusions, even with somewhat rounded edge forms, have an extremely negative effect on the fatigue safety with alternating mechanical stress. This fact must also be taken into consideration in terms of smelting technology, wherein after a liquid steel treatment based on reaction kinetics a two-fold vacuum arc remelting of the steel alloy is to be provided as a rule, in order to adjust a level of purity of the steel alloy according to the invention of less than/equal to D/0.5/DÜNN 1 (A, B, C type inclusions not present) according to ASTM E 45 (measurement area 160 $mm^2$).

When the machine component or part has a modulus of elasticity of the material of greater than about 200,000 MPa, in the elastic range of the mechanical stresses the component or part has lower expansion values and compression values when subjected to alternating mechanical stress, whereby a higher service life is achieved or better fatigue values are given.

The quenched and tempered steel alloy or the material has proven to be particularly useful with respect to the property profile as a machine component in vehicle construction, in particular as an engine part and/or drive train part and/or spring part.

The invention is presented in greater detail below based on test results and comparative diagrams shown in FIGS. 1 to 6.

Based on the results of preliminary tests, steel alloys containing essentially, in % by weight based on the total weight of the alloy, from 0.49 to 0.53 of carbon, from 0.20 to 0.23 of silicon, from 0.36 to 0.42 of manganese, from 4.50 to 4.60 of chromium, from 2.80 to 3.00 of molybdenum, and from 0.70 to 0.85 of vanadium, the remainder being iron and contaminants, were established as materials with a property profile according to the present invention and produced with the highest possible level of purity.

As one skilled in the art is aware, materials of the above composition type are hot-forming steels for use temperatures of up to about 500° C. Surprisingly, it was found that these alloys in the thermally quenched and tempered state can be advantageously used for machine components or parts which are to be subjected to alternating mechanical stress at low temperatures if their chemical composition is within the relatively narrow limits of the alloying elements according to the invention.

Formed and thermally quenched and tempered samples were produced from steel alloys according to the invention with high levels of purity, indicated by W366, which samples were examined in tests to determine characteristic values of the material.

Compared to the material according to the invention, a determination of the characteristic material values of materials treated in the same manner was carried out, which materials according to the prior art have hitherto been used for machine components of the described type and are characterized according to a U.S. standard with a designation 300 M, corresponding to DIN material no. 1.6928, as well as 300 M "improved" with higher Si content in the comparisons.

FIG. 1 shows a comparison of the tensile strength with the highest values for the material according to the present invention.

Figure 2:
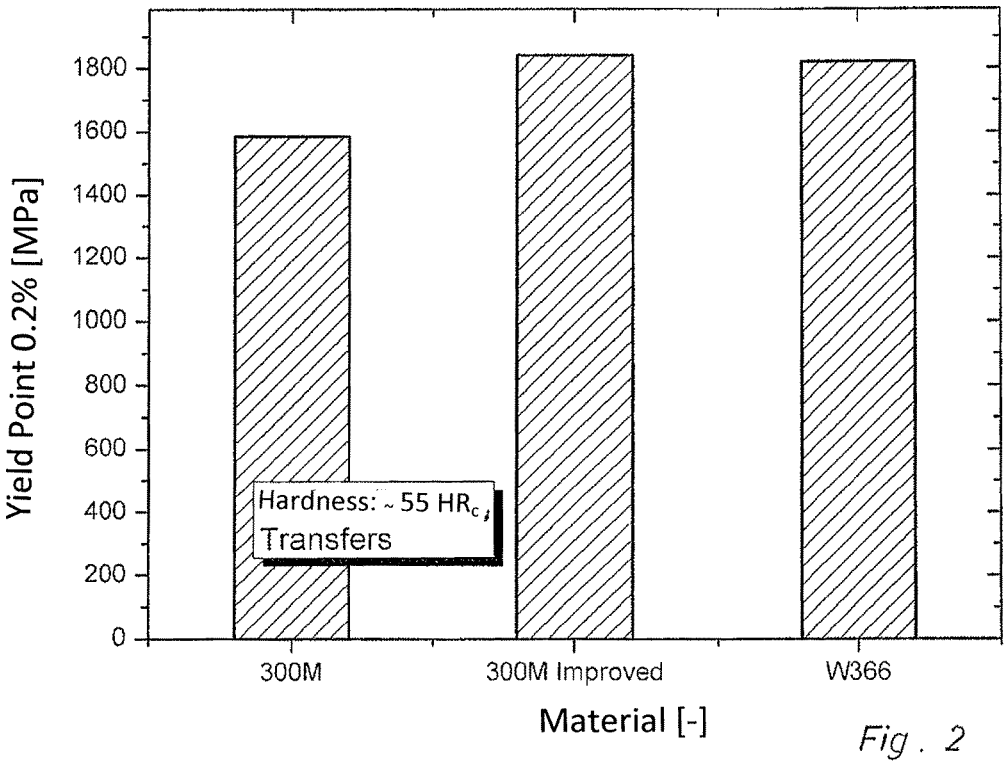
FIG. 2 is a bar chart representing the 0.2% yield points of a part according to the present invention and comparative parts made from alloys of the prior art.

FIG. 2 shows in a bar chart the 0.2% yield strength of the materials, wherein the values of the samples with a composition W366 were at the highest level.

Figure 3:
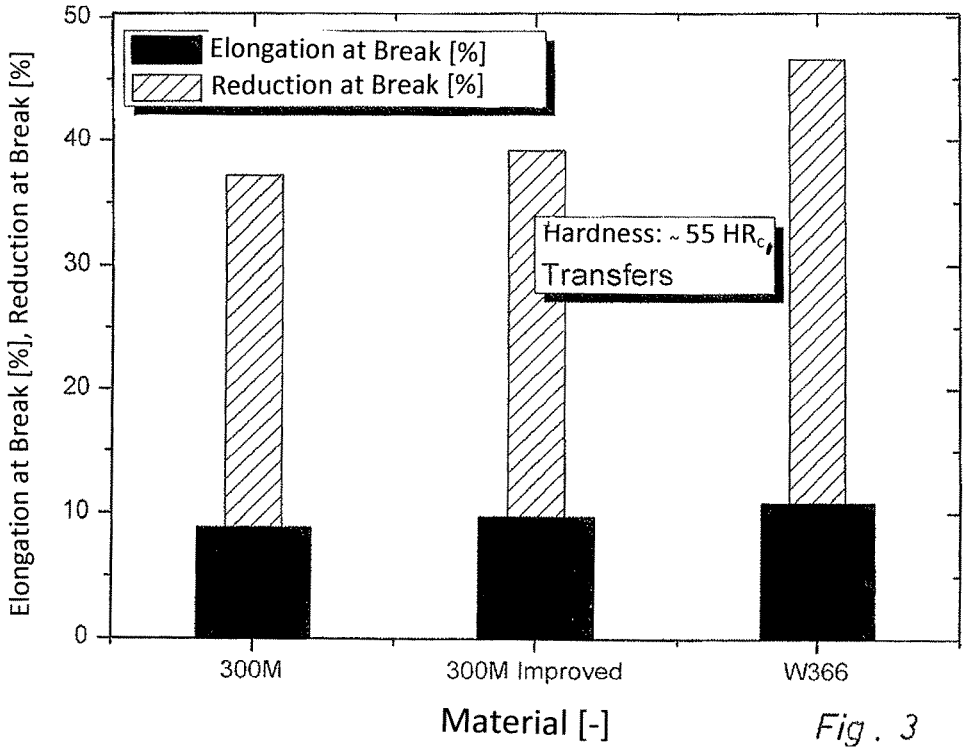
FIG. 3 is a bar chart representing the elongation at break and reduction at break of a part according to the present invention and comparative parts made from alloys of the prior art.

FIG. 3 shows that the values for elongation at break and reduction at break of the material W366 are much higher than those for comparative materials 300 M and 300 M "improved," which reveals significant advantages for the use of the former for machine components which are to be subjected to alternating mechanical stress.

Figure 4:
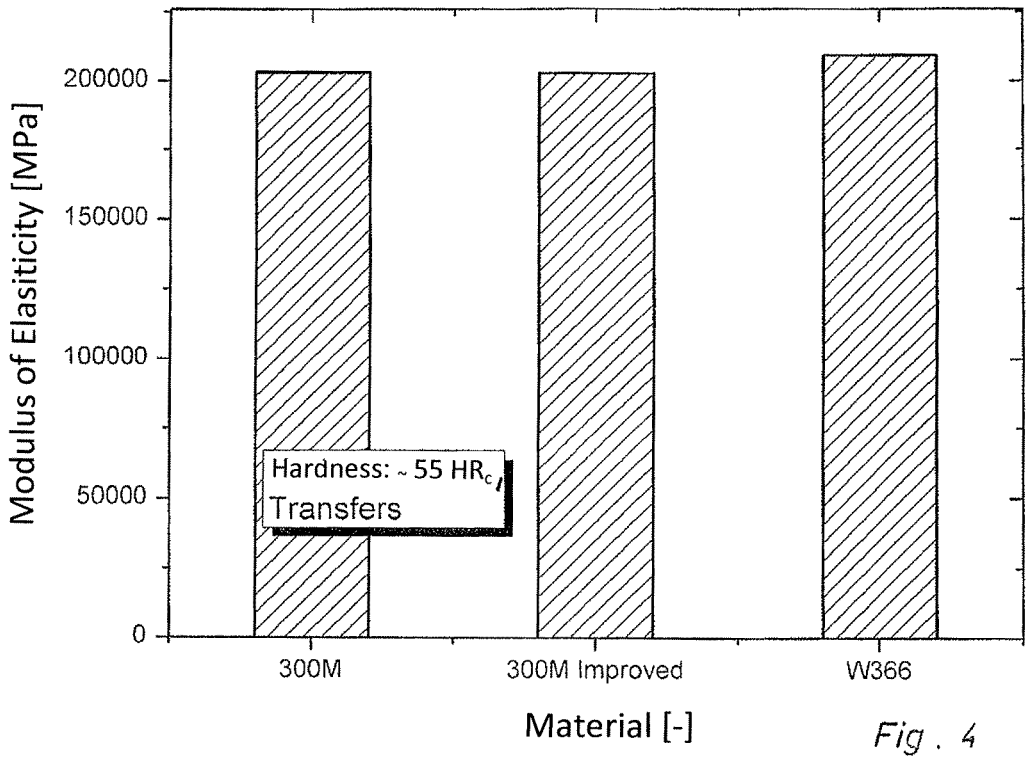
FIG. 4 is a bar chart representing the moduli of elasticity of a part according to the present invention and comparative parts made from alloys of the prior art.

As shown by FIG. 4, the modulus of elasticity of material W366 is also higher compared to the materials according to the prior art, so that in heavy use there are lower elastic deformations with a mechanical stress of the material, which means that a fatigue failure of a part made of W366 is greatly reduced.

Figure 5:
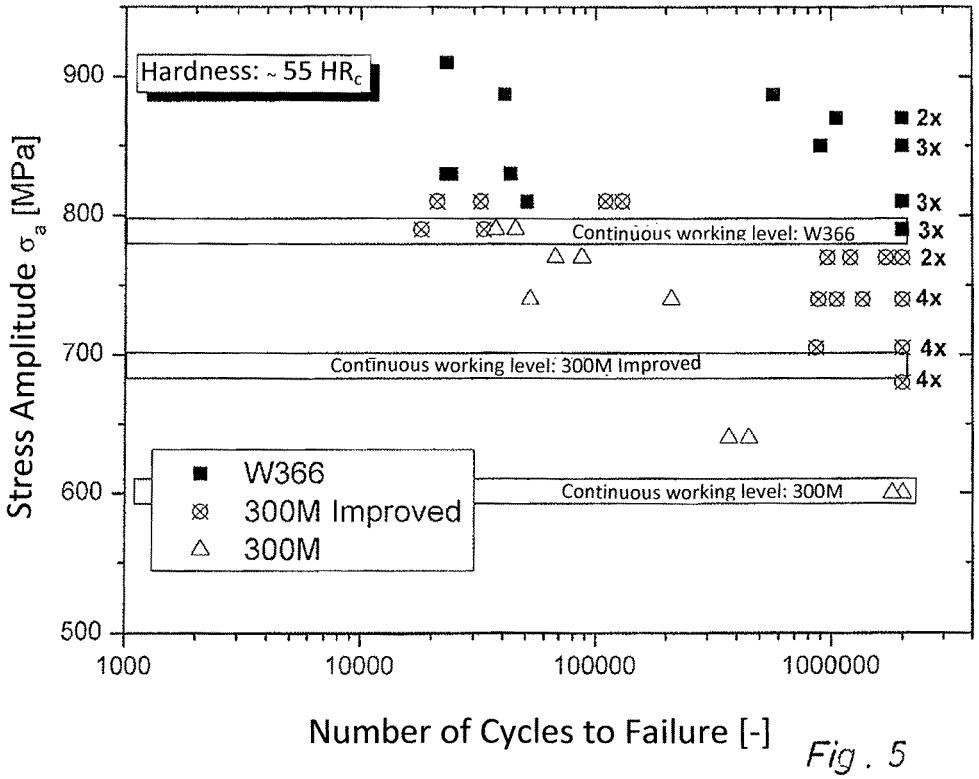
FIG. 5 shows the stress amplitude as a function of the number of cycles to failure of a part according to the present invention and comparative parts made from alloys of the prior art.

FIG. 5 shows the fatigue behavior of the thermally quenched and tempered samples of the tested alloys in a comparison.

With respect to the fatigue behavior it is noted that with cyclically repeated stress, subcritical crack growth occurs in a material. This is caused by microplastic deformations which add up to a relatively large total deformation in the course of the alternating stress. This form of material damage is called fatigue. Even cyclical mechanical stresses that are far below the yield strength can lead to crack formation and crack growth or even to fracture of the material. The endurance limit (fatigue strength) is the limit value for stress at which no more fractures occur even after an infinite number of stress cycles (reversals of stress). To determine the fatigue strength the Wöhler test must be carried out until a limit number of stress cycles $N_G$ has been reached.

With tool steels fractures can occur up to $10^7$ reversals of stress. However, a limit number of cycles of $2\times10^6$ reversals of stress was selected in this test.

The fatigue tests were carried out on a "TESTRONIC" model resonance testing machine by means of four-point bending arrangement. This machine, also known as a continuous vibration testing machine, is a dynamic testing machine that operates at full resonance.

Figure 6:
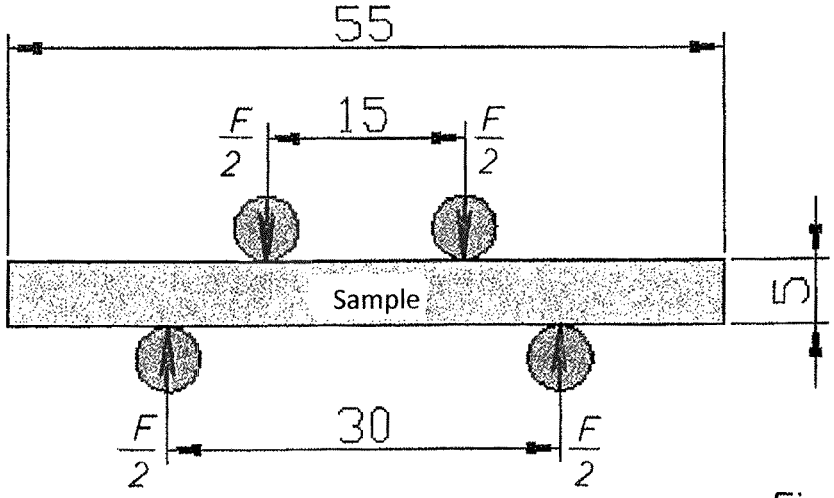
FIG. 6 shows the test set up for obtaining the results shown in FIG. 5.

FIG. 6 shows the four-point bending arrangement diagrammatically. The stress on the samples was conducted via rollers with a diameter of 5 mm. The spacing of the rollers from one another was 15 mm in the upper part and 30 mm in the lower part. Rectangular samples with the following dimensions were used for this test: Height h=5 mm, width b=7 mm, length l=55 mm.

The extreme fiber stress $\sigma_b$ was determined with the assumption of a linear elastic stress distribution according to the equation $$\sigma_b = \frac{M_b}{W_b} = \frac{3xFxx^i}{bxh^2}$$

wherein $M_b = x^i \times F/2$ is the bending moment and $W_b = b\times h^2/6$ is the section modulus of the sample. F is the force acting on the rollers and $x^i$ (=7.5 mm) is the lever arm that together with the time-dependent stress F forms the bending moment.

FIG. 5 clearly shows the advantages regarding an improved fatigue behavior of machine components or parts according to the invention, wherein the value range "continuous working level" characterizes the stress amplitude up to which no fracture of the sample occurs with infinite load cycles.

In order to determine the effect of accompanying elements and contaminant elements on the property profile, the steel alloy according to the invention was doped with these elements in different concentrations, and quenched and tempered samples made therefrom were tested. The results of the tests and the limit values resulting therefrom are given below.

The contaminant elements phosphorus and sulfur cause brittle deposits at hardness values of the material of more than about 53 HRC, wherein a significant increase in the embrittlement could be determined at a concentration of P of more than about 0.005% by weight and at a concentration of S of more than about 0.001% by weight.

Calcium, magnesium, aluminum are deoxidant elements and form oxidic inclusions with oxygen, which, due to the sharp-edged form and with deformed materials because of the linear array, cause disadvantages regarding the fatigue safety of the material, which may also depend on the direction of the deformation. Despite vacuum arc remelting several times, the material tests afforded upper limit values, which are not to be exceeded for the materials according to the invention. These limit values are about 0.01% by weight for Al, about 0.001% by weight for Ca, about 0.001% by weight for Mg and about 0.002% by weight for O.

In particular with alloying elements as well as titanium and oxygen, nitrogen can form sharp-edged nitrides, which cause stress peaks in the micro range through an increased strength and thereby give rise to a crack initiation. The upper limit values of the contents found are about 0.003% by weight for N and about 0.005% by weight for Ti.

Nickel, copper and cobalt in low concentrations represent interstitial elements in the crystal formation of the alloy, but should not exceed contents of about 0.1% by weight in each case because of a disadvantageous effect of lattice defects on the long-term properties of the material.

Due to the extremely low solubility in iron-based materials, tin is to be seen as an element covering the grain boundaries and, at concentrations higher than about 0.005% by weight, has an extremely negative effect on the fatigue properties and in particular the toughness properties of a component subjected to alternating mechanical stress.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A machine component or part for alternating mechanical stresses up to a temperature of up to about 160° C., wherein the component or part comprises a thermally quenched and tempered steel alloy consisting of in % by weight, based on a total weight of the alloy:

| | |
|---|---|
| Carbon (C) | from 0.48 to 0.55 |
| Silicon (Si) | from 0.18 to 0.25 |
| Manganese (Mn) | from 0.35 to 0.45 |
| Chromium (Cr) | from 4.40 to 4.70 |
| Molybdenum (Mo) | from 2.90 to 3.10 |
| Vanadium (V) | from 0.72 to 0.77 |

| | |
|---|---|
| Phosphorus (P) | not more than 0.005 |
| Sulfur (S) | not more than 0.001 |
| Nickel (Ni) | not more than 0.1 |
| Copper (Cu) | not more than 0.1 |
| Cobalt (Co) | not more than 0.1 |
| Titanium (Ti) | not more than 0.005 |
| Aluminum (Al) | not more than 0.01 |
| Nitrogen (N) | not more than 0.003 |
| Oxygen (O) | not more than 0.002 |
| Calcium (Ca) | not more than 0.001 |
| Magnesium (Mg) | not more than 0.001 |
| Tin (Sn) | not more than 0.005, |

remainder iron (Fe), and wherein the component or part has a tensile strength of greater than about 2,000 MPa and a hardness adjusted through thermal quenching and tempering of greater than about 54 HRC.

2. The component or part of claim 1, wherein the component or part has a hardness adjusted through thermal quenching and tempering of greater than about 55 HRC.

3. The component or part of claim 2, wherein the component or part has a modulus of elasticity of a material of greater than about 205,000 MPa.

4. The component or part of claim 1, wherein the component or part has a modulus of elasticity of a material of greater than about 200,000 MPa.

5. The component or part of claim 1, wherein the component or part has a modulus of elasticity of a material of greater than about 205,000 MPa.

6. A vehicle which comprises the component or part of claim 1.

7. An engine of a vehicle, wherein the engine comprises the component or part of claim 1.

8. A drive train of a vehicle, wherein the drive train comprises the component or part of claim 1.

9. A spring of a vehicle, wherein the spring comprises the component or part of claim 1.

10. A method of manufacturing a machine component or part having a tensile strength of greater than about 2,000 MPa and a hardness of 54 HRC for alternating mechanical stresses up to a temperature of up to about 160° C., wherein the method comprises manufacturing the component or part by using a thermally quenched and tempered steel alloy consisting of in % by weight, based on a total weight of the alloy:

| | |
|---|---|
| Carbon (C) | from 0.48 to 0.55 |
| Silicon (Si) | from 0.18 to 0.25 |
| Manganese (Mn) | from 0.35 to 0.45 |
| Chromium (Cr) | from 4.40 to 4.70 |
| Molybdenum (Mo) | from 2.90 to 3.10 |
| Vanadium (V) | from 0.72 to 0.77 |

| | |
|---|---|
| Phosphorus (P) | not more than 0.005 |
| Sulfur (S) | not more than 0.001 |
| Nickel Ni | not more than 0.1 |
| Copper (Cu) | not more than 0.1 |
| Cobalt (Co) | not more than 0.1 |
| Titanium (Ti) | not more than 0.005 |
| Aluminum (Al) | not more than 0.01 |
| Nitrogen (N) | not more than 0.003 |
| Oxygen (O) | not more than 0.002 |
| Calcium (Ca) | not more than 0.001 |
| Magnesium (Mg) | not more than 0.001 |
| Tin (Sn) | not more than 0.005. |

11. The method of claim 10, wherein the component or part has a modulus of elasticity of a material of greater than about 200,000 MPa.

12. The method of claim 10, wherein the component or part is a component or part of a vehicle.

* * * * *